US011149516B2

(12) United States Patent
Machocki

(10) Patent No.: US 11,149,516 B2
(45) Date of Patent: Oct. 19, 2021

(54) HIGH PRESSURE SEALING TOOL FOR USE IN DOWNHOLE ENVIRONMENT

(71) Applicant: Saudi Arabian Oil Company, Dhahran (SA)

(72) Inventor: Krzysztof Karol Machocki, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 272 days.

(21) Appl. No.: 16/423,949

(22) Filed: May 28, 2019

(65) Prior Publication Data

US 2020/0378210 A1 Dec. 3, 2020

(51) Int. Cl.

| | |
|---|---|
| ***E21B 33/124*** | (2006.01) |
| *E21B 33/122* | (2006.01) |
| *E21B 33/128* | (2006.01) |
| *E21B 34/16* | (2006.01) |

(52) U.S. Cl.

CPC ..... *E21B 33/124* (2013.01); *E21B 33/122* (2013.01); *E21B 33/128* (2013.01); *E21B 34/16* (2013.01)

(58) Field of Classification Search

CPC .... E21B 33/124; E21B 33/122; E21B 33/128; E21B 34/16; E21B 33/12; E21B 33/134; E21B 33/16

See application file for complete search history.

(56) References Cited

U.S. PATENT DOCUMENTS

| | | | | |
|---|---|---|---|---|
| 3,716,101 | A | 2/1973 | Mcgowen, Jr. et al. | |
| 4,484,625 | A * | 11/1984 | Barbee, Jr. | E21B 37/08 166/185 |
| 6,257,338 | B1 | 7/2001 | Kilgore | |
| 6,478,096 | B1 | 11/2002 | Jones et al. | |
| 7,571,765 | B2 | 8/2009 | Themig | |
| 7,708,062 | B2 | 5/2010 | Carro | |
| 7,789,163 | B2 | 9/2010 | Kratochvil et al. | |

(Continued)

FOREIGN PATENT DOCUMENTS

WO 2016137440 A1 8/2016

OTHER PUBLICATIONS

International Search Report and Written Opinion for PCT Application No. PCT/US2020/034755 dated Jul. 16, 2020, 11 pages.

*Primary Examiner* — Yong-Suk (Philip) Ro

(74) *Attorney, Agent, or Firm* — Bracewell LLP; Constance G. Rhebergen; Linda L. Morgan

(57) ABSTRACT

A sealing assembly for forming a seal within a subterranean well includes a sealing tool having a mandrel. Two or more seal members circumscribe the mandrel. The seal members are moveable between a retracted position and an extended position. A seal actuator can move the seal members between the retracted position and the extended position. A pressure communication port is located between adjacent of the two or more seal members, the pressure communication port extending from the central passage of the mandrel to an exterior of the sealing tool. A pressure communication valve is associated with the pressure communication port, the pressure communication valve operable to move between an open position where the pressure communication valve provides a path for flow of a fluid between the central passage and the exterior of the sealing tool between adjacent of the two or more seal members, and a closed position.

17 Claims, 3 Drawing Sheets

(56) References Cited

U.S. PATENT DOCUMENTS

| | | | |
|---|---|---|---|
| 7,861,774 | B2 | 1/2011 | Fehr et al. |
| 8,037,938 | B2 | 10/2011 | Jardim et al. |
| 9,719,336 | B2 | 7/2017 | Lynn |
| 2009/0183882 | A1 | 7/2009 | Van Zuilekom et al. |
| 2012/0012342 | A1 | 1/2012 | Wilkin et al. |
| 2013/0087322 | A1 | 4/2013 | Rowe et al. |
| 2015/0007985 | A1 | 1/2015 | Gisolf |
| 2020/0181995 | A1* | 6/2020 | Blakey ..... E21B 23/06 |

* cited by examiner

HIGH PRESSURE SEALING TOOL FOR USE IN DOWNHOLE ENVIRONMENT

BACKGROUND OF THE DISCLOSURE

1. Field of the Disclosure

The present disclosure relates to subterranean developments, and more specifically, the disclosure relates to sealing members used during subterranean well treatment, evaluation, or testing operations.

2. Description of the Related Art

Recent hydrocarbon developments have been proposed that involve subterranean wells having higher downhole temperatures and pressures than some current hydrocarbon developments. During the development of the high temperature and high pressure wells, there are times when a pressure reduction in a section of the wellbore is required in order to perform downhole operations. As an example, downhole pressure may need to be reduced in a portion of the wellbore for well testing, installing an open hole plug, performing selective hydraulic fracturing, or for providing a down hole blowout preventer for drilling applications. In certain instances the reduction in pressure of the portion of the wellbore is taking place in an open hole region of the subterranean well. Because the pressure reduction is only undertaken for a portion of the wellbore, there can be a significant pressure differential across the sealing member that is isolating the portion of the wellbore, where the pressure is being reduced, from the adjacent portion of the wellbore, where the high pressure is being maintained.

SUMMARY OF THE DISCLOSURE

Some current packers for sealing a portion of a wellbore can accommodate a pressure differential across the sealing member of up to 8,000 pounds per square inches (psi) at temperatures of up to 280 degrees Fahrenheit (° F.). Such packers may not be capable of sealing a portion of a well bore at higher pressures or temperatures. When downhole temperatures increase, the capability of the packer sealing element to withstand pressure reduces. In addition, when operating in an open hole formation, packers must seal against the wellbore wall instead of against casing or other tubing. The open hole wellbore wall could have washouts along the profile, an uneven or oval shape, a larger diameter than previously estimated, or a rough surface. Such irregularities in the wellbore wall would lead to larger outer expansion of packer sealing element. This larger outer expansion of the sealing element could further reduce capability of the packer to withstand a pressure differential across the sealing element.

In subterranean wells in which the temperature, pressure, or wellbore irregularities would not allow for currently available sealing elements to safely seal across the wellbore for the required pressure differential, an operator might decide to mitigate or avoid the risk of packer failure. The consequences of a sealing element failure could lead to losing the hydrostatic safety barrier and result in an uncontrolled hydrocarbon flow to the surface, commonly known as a blowout. The operator could then choose to delay the hydrocarbon development to allow for time to run casing, perform a cementing job, evaluate the cement job, and provide for any additional remediation work such as second stage cement jobs, in order to provide for a safer sealing system within the cased well. There may be other times in which even in a cased well, the temperatures and pressure differential cannot be managed by currently available seal assemblies.

Systems and methods of this disclosure provide a sealing assembly that can be adjusted to withstand a desired pressure differential across sealing assembly, even in conditions with high temperatures and high pressures and where the wellbore inner surface has irregularities, by adding successive seal members. Embodiments of this disclosure can eliminate the need to case a well when currently available seal members would not function safely in the open hole portion of the wellbore.

In an embodiment of this disclosure, a sealing assembly for forming a seal within a subterranean well includes a sealing tool. The sealing tool has a mandrel, the mandrel being an elongated tubular member with a central passage. Two or more seal members circumscribe the mandrel. The seal members are moveable between a retracted position where the two or more seal members have a minimal outer diameter and an extended position where the two or more seal members have an expanded outer diameter. A seal actuator is operable to move the two or more seal members between the retracted position and the extended position. A pressure communication port is located between adjacent of the two or more seal members. The pressure communication port includes an opening through a sidewall of the mandrel extending from the central passage to an exterior of the sealing tool. A pressure communication valve is associated with the pressure communication port. The pressure communication valve is operable to move between an open position where the pressure communication valve provides a path for flow of a fluid between the central passage and the exterior of the sealing tool between adjacent of the two or more seal members, and a closed position where the pressure communication valve prevents flow of the fluid through the pressure communication port.

In alternate embodiments, a number of pressure communication ports can be one less than a number of seal members. The seal actuator can include a piston assembly operable to move all of the two or more seal members between the retracted position and the extended position.

In other alternate embodiments the sealing assembly can further include a second end port. The second end port can be located on a second side of all of the two or more seal members. A second end valve can be associated with the second end port. The second end valve can be operable to move between an open position where the second end valve provides a path for flow of the fluid between the central passage and the exterior of the mandrel on a second side of all of the two or more seal members, and a closed position where the second end valve prevents flow of the fluid through the second end port.

In yet other alternate embodiments the sealing assembly can further include a first end port. The first end port can be located on first side of all of the two or more seal members. A first end valve can be associated with the first end port. The first end valve can be operable to move between an open position where the first end valve provides a path for flow of the fluid between the central passage and an exterior of the sealing assembly on first side of all of the two or more seal members, and a closed position where the first end valve prevents flow of the fluid through the first end port.

In still other alternate embodiments, the sealing assembly can further include a communication system. The communication system can be operable to instruct the pressure communication valve to move between the open position and the closed position. The sealing tool can include a first connector oriented to secure the sealing tool to a first string, and a second connector oriented to secure the sealing tool to a second string. The first string and the second string each can have an inner bore axially aligned and in fluid communication with the central passage of the mandrel. A pressure gauge can be operable to measure a pressure of the fluid.

In another embodiment of this disclosure a sealing assembly for forming a seal within a subterranean well includes a sealing tool. The sealing tool is located within the subterranean well, defining an annular space between an exterior surface of the sealing tool and an interior surface of the subterranean well. The sealing tool can have a mandrel, the mandrel being an elongated tubular member with a central passage. Two or more seal members circumscribe the mandrel. The seal members are moveable between a retracted position where the two or more seal members are spaced apart from the interior surface of the subterranean well and an extended position where the two or more seal members form a seal with the interior surface of the subterranean well. A pressure communication port is located between adjacent of the two or more seal members. The pressure communication port includes an opening through a sidewall of the mandrel and extends from the central passage to the annular space between adjacent of the two or more seal members. The pressure communication port has a pressure communication valve operable to move between an open position and a closed position. A first string is secured to a first connector of the sealing tool. The first string has a first inner bore axially aligned and in fluid communication with the central passage of the mandrel. A second string is secured to a second connector of the sealing tool. The second string has a second inner bore axially aligned and in fluid communication with the central passage of the mandrel. A first end port extends through a sidewall of the first string. The first end port has a first end valve operable to move between an open position and a closed position.

In alternate embodiments the sealing assembly can further include a piston assembly operable to move all of the two or more seal members between the retracted position and the extended position.

In other alternate embodiments the sealing assembly can further include a second end port. The second end port can be an opening through a sidewall of the mandrel extending from the central passage to the annular space on a second side of all of the two or more seal members. The second end port can have a second end valve operable to move between an open position and a closed position.

In yet other alternate embodiments the sealing assembly can further include a communication system. The communication system can be operable to instruct the pressure communication valve to move between the open position and the closed position. A pressure gauge can be operable to measure a pressure of the fluid.

In yet another embodiment of the disclosure a method for forming a seal within a subterranean well with a sealing assembly includes providing a sealing tool. The sealing tool has a mandrel, the mandrel being an elongated tubular member with a central passage. The sealing tool also has two or more seal members circumscribing the mandrel. The seal members are moveable between a retracted position where the two or more seal members have a minimal outer diameter, and an extended position where the two or more seal members have an expanded outer diameter. A seal actuator is operable to move the two or more seal members between the retracted position and the extended position. A pressure communication port is located between adjacent of the two or more seal members. The pressure communication port includes an opening through a sidewall of the mandrel and extends from the central passage to an exterior of the sealing tool. A pressure communication valve is associated with the pressure communication port. The pressure communication valve is operable to move between an open position where the pressure communication valve provides a path for flow of a fluid between the central passage and the exterior of the sealing tool between adjacent of the two or more seal members, and a closed position where the pressure communication valve prevents flow of the fluid through the pressure communication port. The method further includes engaging an interior surface of the subterranean well with each of the two or more seal members.

In alternate embodiments the seal actuator can include a piston assembly and the method can further include moving all of the two or more seal members between the retracted position and the extended position with the piston assembly. A second end port can be located on a second side of all of the two or more seal members. A second end valve can be associated with the second end port. The second end valve can be operable to move between an open position where the second end valve provides a path for flow of the fluid between the central passage and the exterior of the mandrel on a second side of all of the two or more seal members, and a closed position where the second end valve prevents flow of the fluid through the second end port. The method can further include moving the second end valve from the open position to the closed position after moving each of the two or more seal members from the retracted position to the extended position.

In other alternate embodiments a first end port can be located on first side of all of the two or more seal members. A first end valve can be associated with the first end port. The first end valve can be operable to move between an open position where the first end valve provides a path for flow of the fluid between the central passage and an exterior of the sealing assembly on first side of all of the two or more seal members, and a closed position where the first end valve prevents flow of the fluid through the first end port. When both the second end valve is in the open position and the first end valve is in the open position, a second side pressure within the subterranean well radially outward of the sealing tool and on a second side of all of the two or more seal members can be equal to a first side pressure within the subterranean well radially outward of the sealing tool and on first side of all of the two or more seal members.

In yet other alternate embodiments the method can further include instructing the pressure communication valve to move between the open position and the closed position with a communication system operable. The method can further include securing the sealing tool to a first string with a first connector and securing the sealing tool to a second string with a second connector, the first string and the second string each having an inner bore axially aligned and in fluid communication with the central passage of the mandrel. A pressure of the fluid can be measured with a pressure gauge.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
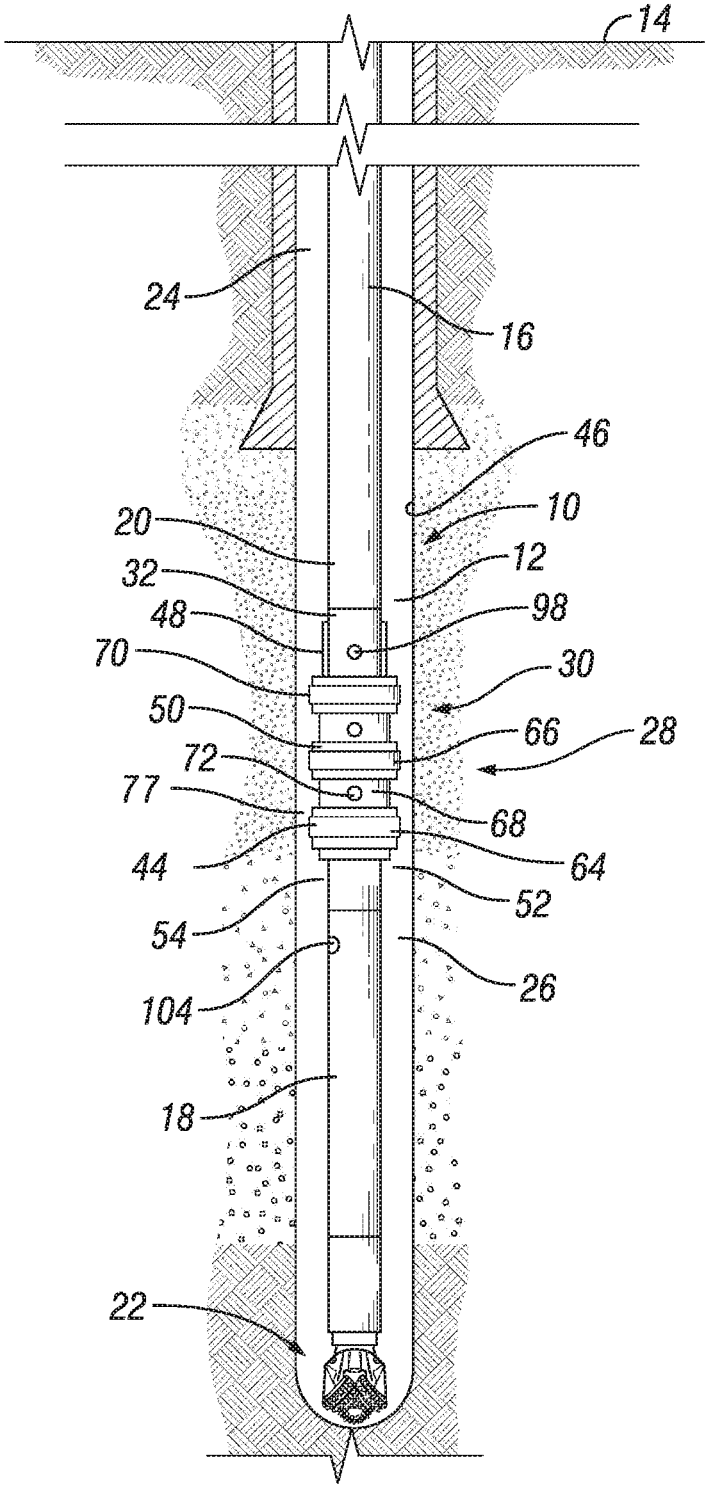
FIG. 1 is a section view of an open hole subterranean well with a sealing assembly, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. String 16 can be lowered into and located within wellbore 12. String 16 can include first string 18 and second string 20.

In the example of FIG. 1, string 16 is a drill string having bottom hole assembly 22. Bottom hole assembly 22 can include, for example, drill collars, stabilizers, reamers, shocks, a bit sub and the drill bit. When string 16 is a drill string, string 16 can be used to drill wellbore 12. In certain embodiments, string 16 can be rotated to rotate the bit to drill wellbore 12. In alternate embodiments, string 16 can be a wired drill pipe, coil tubing, smart coil tubing, or other known tubular or line used to deliver tools into subterranean wells.

In the example of FIG. 1, string 16 passes through cased bore 24 of wellbore 12 before reaching open hole bore 26 of wellbore 12. In alternate embodiments wellbore 12 can be a fully cased bore without any open hole bore.

During hydrocarbon development operations associated with wellbore 12 a seal across wellbore 12 may be required. As an example a seal across wellbore 12 may be required for an open hole or cased bore plug, for selective fracking, for a down hole blowout preventer for drilling applications, or for other applications when testing, evaluating, or treating of subterranean well 10 is desired or required. Such operations may be undertaken in a wellbore 12 where high pressure, high temperature, or both high pressure and high temperature conditions are expected. As used in this disclosure, a high pressure condition within wellbore 12 can be a pressure in a range of 10,000 to 15,000 pounds per square inch (psi). In alternate embodiments, a high pressure condition within wellbore 12 can be a pressure larger than 15,000 psi. In certain embodiments, a high pressure can be a pressure greater than 10,000 psi. As used in this disclosure, a high temperature condition within wellbore 12 can be a temperature in a range of 300 to 350° F. In alternate embodiments, a high temperature condition within wellbore 12 can be a temperature higher than 350° F. In certain embodiments, a high temperature can be a temperature greater than 350° F. In this disclosure the adverse well conditions of an embodiment of an example subterranean well can include a downhole pressure of 10,000 psi, a temperature greater than 350° F., and an irregular open hole wellbore.

Sealing assembly 28 can be used to form a seal within subterranean well 10. Sealing assembly 28 includes sealing tool 30. A first end of sealing tool 30 is secured to first string 18. A second end of sealing tool 30 is secured to second string 20. Sealing tool 30 is therefore in line with string 16 and is delivered into subterranean well 10 with string 16.

Figure 2:
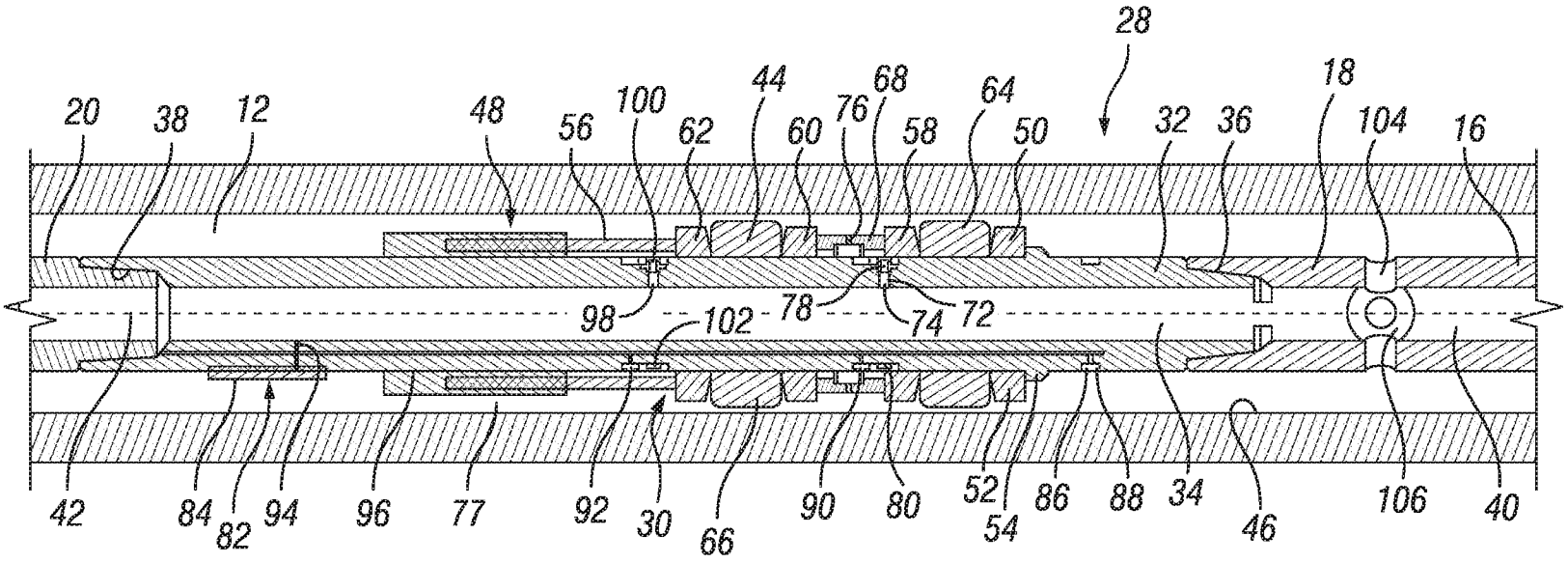
FIG. 2 is a section view of a sealing assembly, shown with the sealing elements in a retracted position, in accordance with an embodiment of this disclosure.

Looking at FIG. 2, sealing tool 30 includes mandrel 32. Mandrel 32 is an elongated tubular shaped member with central passage 34. Mandrel 32 can be formed, as an example, of high tensile steel or if located in a corrosive environment, a non-magnetic alloy such as austenitic nickel-chromium-based superalloys. In the example embodiment of FIG. 2 mandrel 32 is a single elongated tubular shaped member. In alternate embodiments mandrel 32 can be formed by joining together multiple separate segments to form mandrel 32. In embodiments where mandrel 32 is formed of multiple separate segments, assembly and redressing of sealing tool 30 may be simpler compared to embodiments where mandrel 32 is formed of a single elongated tubular shaped member.

Mandrel 32 includes first connector 36. First connector 36 is oriented to secure sealing tool 30 to first string 18. In the example embodiment of FIG. 2, first connector 36 is shown as a threaded connector. In alternate embodiments first connector 36 can be another type of connector used to secure a downhole tool to a string.

Mandrel 32 includes second connector 38. Second connector 38 is located at an opposite end of mandrel 32 from first connector 36. Second connector 38 is oriented to secure sealing tool 30 to second string 20. In the example embodiment of FIG. 2, second connector 38 is shown as a threaded connector. In alternate embodiments second connector 38 can be another type of connector used to secure a downhole tool to a string.

When sealing tool 30 is secured to first string 18, first inner bore 40 of first string 18 is axially aligned and in fluid communication with central passage 34 of mandrel 32. When sealing tool 30 is secured to second string 20, second inner bore 42 of second string 20 is axially aligned and in fluid communication with central passage 34 of mandrel 32.

Sealing Tool 30 includes two or more seal members 44. In the example embodiment of FIG. 1, there are three seal members 44. In the example embodiment of FIGS. 2 and 3 there are two seal members 44. In alternate embodiments there can be more than three seal members 44.

Figure 3:
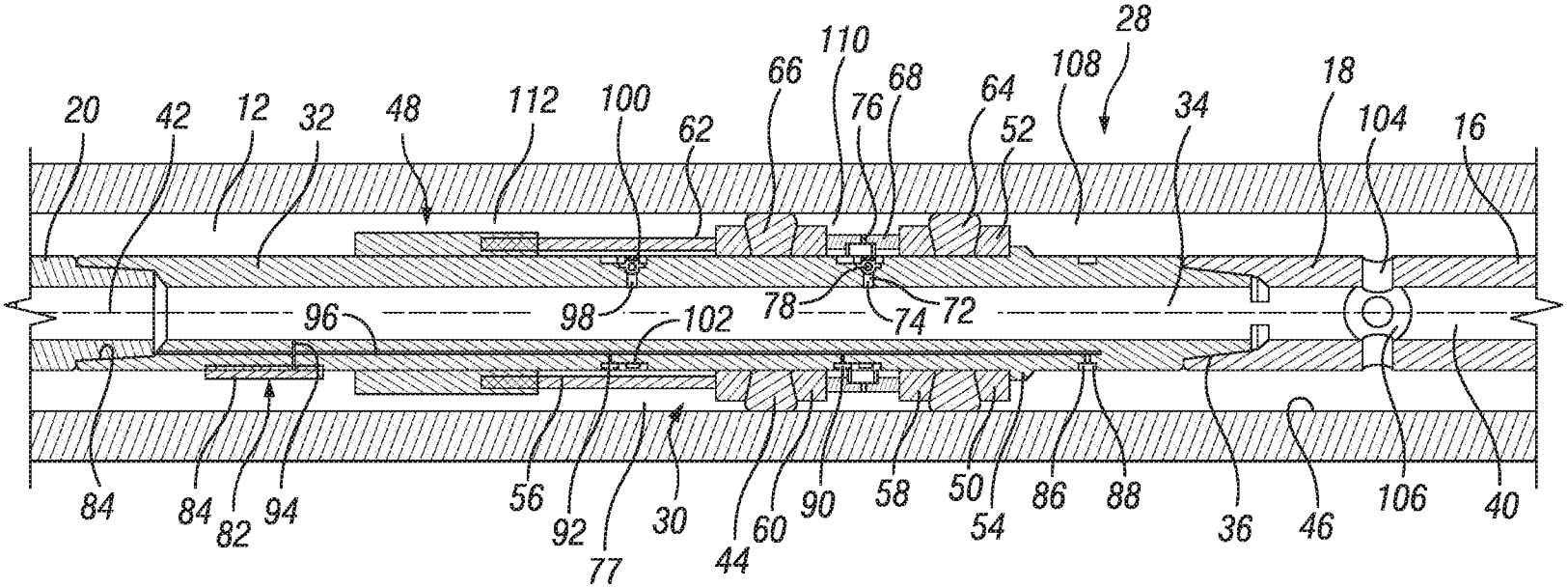
FIG. 3 is a section view of a sealing assembly, shown with the sealing elements in an extended position, in accordance with an embodiment of this disclosure.

Seal members 44 circumscribe mandrel 32. Seal members 44 are moveable between a retracted position (FIG. 2) and an extended position (FIG. 3). Seal members 44 are capable of being moved from the retracted position to the extended position and back to the retracted position multiple times.

Looking at FIG. 2, when seal members 44 are in a retracted position seal members 44 have a minimal outer diameter. In the retracted position seal members are disengaged from interior surface 46 of subterranean well 10 and are spaced apart from interior surface 46 of subterranean well 10. Looking at FIG. 3, when seal members 44 are in an extended position seal members 44 have an expanded out diameter. The expanded outer diameter of seal members 44 is larger than the minimal outer diameter of seal members 44. When seal members 44 are in the extended position seal members 44 are engaged with interior surface 46 of subterranean well 10 and form a seal with interior surface 46 of subterranean well 10.

In the example embodiments of FIGS. 2 and 3, seal members 44 are compression seals. In such an embodiment, seal members 44 can be formed of an elastomer or can be formed of silicone, fluorocarbon, fluoroelastomer, fluorosilicone, polyacrylate, or hydrogenated nitrile butadiene rubber. Each of the seal members 44 is a ring shaped member that circumscribes mandrel 32. Each of the seal members 44 can have the capability of maintaining a seal with interior surface 46 of subterranean well 10 when there is a pressure differential across the seal member 44 even when interior surface 46 is an uneven surface. Each seal member 44 can provide a pressure barrier in a range between 4,000 psi and 8,000 psi across seal member 44, depending on the downhole conditions, such as temperature, pressure, and the irregularity of the inner surface of the wellbore. In conditions with a pressure in excess of 10,000 psi, a temperature of 350° F. or greater, or an irregular wellbore, seal member 44 may only safely provide a pressure barrier with a pressure differential across seal member 44 of 4,000 psi. In alternate embodiments, seal members 44 can be inflatable seals or spring actuated seals.

Sealing tool 30 further includes seal actuator 48. Seal actuator 48 is operable to move seal members 44 between the retracted position and the extended position. In the example embodiments of FIGS. 2 and 3, seal actuator 48 is a piston assembly. The piston assembly can move all of the seal members 44 between the retracted position and the extended position. Piston member 56 of seal actuator 48 can be moved by known methods in the industry such as pressure, electromechanical or electrohydraulic motors, or pipe manipulation such as rapid movement downwards.

Piston member 56 of the example embodiments of FIGS. 2 and 3 is a piston rod and multiple piston rods are spaced around an outer circumference of mandrel 32. An actuated end of piston member 56 is located within a piston chamber. An opposite end of piston member 56 is an operational end of piston member 56 and is in contact with a seal support 50. Looking at FIG. 2, each seal member 44 has a seal support 50 at both a first side and an opposite second side of seal member 44. Seal support 50 is a ring shaped member that circumscribes mandrel 32.

Axial movement of the primary first seal support 52 is limited by mandrel shoulder 54. Mandrel shoulder 54 is a ring shaped shoulder along an outer diameter surface of mandrel 32 with a shoulder surface that faces in a direction towards seal actuator 48. As piston member 56 of seal actuator 48 is moved axially towards supports 50, secondary first seal support 58, primary second seal support 60, and secondary second seal support 62 would each move axially in a direction towards mandrel shoulder 54. If primary first seal support 52 is not in contact with mandrel shoulder 54, primary first seal support 52 would also move towards mandrel shoulder 54 until primary first seal support 52 contacts mandrel shoulder 54.

As secondary first seal support 58 moves axially towards primary first seal support 52, first seal member 64 is compressed between sloped shoulders of primary first seal support 52 and secondary first seal support 58. The compression of first seal member 64 causes radial extrusion of first seal member 64 and first seal member 64 is moved from the retracted position (FIG. 2) to the extended position (FIG. 3).

Spacer 68 is located between secondary first seal support 58 and primary second seal support 60. Spacer 68 maintains a set minimum distance between secondary first seal support 58 and primary second seal support 60. Continued axial movement of piston member 56 towards supports 50 will cause secondary second seal support 62 to move closer to primary second seal support 60. As secondary second seal support 62 moves closer to primary second seal support 60, second seal member 66 is compressed between sloped shoulders of primary second seal support 60 and secondary second seal support 62. The compression of second seal member 66 causes radial extrusion of second seal member 66 and second seal member 66 is moved from the retracted position (FIG. 2) to the extended position (FIG. 3).

In the example embodiment of FIG. 1 where there is a third seal member 70, and in embodiments where there are more than three seal members, each additional seal member 44 will be moved from the retracted position to the extended position in a similar manner as described for second seal member 66, through compression between sloped shoulders of associated adjacent supports 50.

In alternate embodiments where inflatable seals are used, a controlled fluid can be pumped from a controlled reservoir into the seal members. The controlled fluid acts on the sealing element walls from the inside in similar way as water balloons, allowing the seal members to inflate and engage the inner surface of the wellbore. Each inflatable seal can provide a pressure barrier in a range between 4,000 psi and 8,000 psi across the seal member, depending on the downhole conditions, such as temperature, pressure, and the irregularity of the inner surface of the wellbore.

Looking at FIG. 3, sealing tool 30 includes pressure communication port 72 located between each adjacent of the seal members 44. Each pressure communication port 72 extends from central passage 34 of mandrel 32 to an exterior of sealing tool 30. Pressure communication port 72 includes inner communication opening 74 through a sidewall of mandrel 32 and outer communication opening 76 through spacer 68. When seal members 44 are in the extended position, inner communication opening 74 and outer communication opening 76 are in fluid communication so that pressure communication port 72 extends from central passage 34 of mandrel 32 to annular space 77 between adjacent seal members 44. Annular space 77 is defined between an exterior surface of sealing assembly 28, such as sealing tool 30 or string 16, and an interior surface 46 of subterranean well 10.

The number of pressure communication ports 72 can be one less than a number of seal members 44. In the example embodiment of FIGS. 2 and 3 where there are two seal members 44 there is one pressure communication port 72. In the example embodiment of FIG. 1 where there are three seal members 44 there are two pressure communication ports 72. In alternate embodiments, more than one pressure communication port 72 can be located between adjacent seal members 44 to ensure safe and reliable operation of sealing assembly 28 even if one pressure communication port 72 was to fail.

A pressure communication valve 78 is associated with each pressure communication port 72. Pressure communication valve 78 can be used to adjust the pressure across a seal member 44. Pressure communication valve 78 can be located within the sidewall of mandrel 32 along inner communication opening 74. Each pressure communication valve 78 is operable to move between an open position and a closed position. When pressure communication valve 78 is in the open position pressure communication valve 78 provides a path for flow of a fluid between central passage 34 and the exterior of the sealing tool 30 between adjacent of the seal members 44. When pressure communication valve 78 is in the closed position pressure communication valve 78 prevents flow of the fluid between central passage 34 and the exterior of sealing tool 30 through pressure communication port 72. Pressure communication valve 78 can be moved between the open position and the closed position to control a pressure differential between central passage 34 of mandrel 32 and annular space 77 between adjacent seal members 44.

In example embodiments pressure communication valve 78 can withstand a pressure differential of up to 20,000 psi and can prevent or allow the flow of fluid in either direction through pressure communication valve 78. Pressure communication valve 78 can therefore manage a pressure differential where the pressure within central passage 34 is larger than the pressure within annular space 77 between adjacent seal members 44, and can manage a pressure differential where the pressure within central passage 34 is smaller than the pressure within annular space 77 between adjacent seal members 44.

As an example, pressure communication valve 78 can be used to vent fluid from a higher pressure location to a lower pressure location in either direction through pressure communication valve 78. In this way pressure communication valve 78 can be used to equalize a pressure within central passage 34 with the pressure within annular space 77 between adjacent seal members 44. In alternate embodiments, pressure communication valve 78 could vent pressure into a separate pressure chamber (not shown) that is part of sealing tool 30.

Pressure communication valve 78 can be operated by electromechanical actuators 80 that allow pressure communication valve 78 to move between the open and the closed positions as required and on demand. Communication system 82 can instruct each pressure communication valve 78 separately to move between the open position and the closed position with electromechanical actuators 80. Instructions for the operation of electromechanical actuators 80 for pressure communication valve 78 could be sent from the surface to communication system 82 by commonly used methods in the industry such as, for example, a copper or fiber cable, acoustic signal, radio-frequency identification tag, or mud pulse. Alternatively commands to operate electromechanical actuator 80 for each pressure communication valve 78 could be preprogramed into communication system 82. Pre-set values for various temperate and pressure conditions could be preprogrammed into communication system 82 so that each valve and seal member 44 could be operated without the requirement of signal from the surface.

In the example embodiments of FIGS. 2 and 3 communication system 82 includes a communication module 84. Communication module 84 can be secured to mandrel 32 and can act as both a transmitter and a receiver. Communication module 84 can include an integrated power supply. Communication module 84 can also receive information from a number of pressure gauges 86. Pressure gauges 86 can measure a pressure within annular space 77 and within central passage 34. In addition to pressure information, communication system 82 can gather information relating to the condition of each valve and seal member 44. For example, communication system 82 can determine if a particular valve is in an open position, a closed position, or a partially open position. Communication system can alternately determine if a particular seal member 44 is in a retracted position or an extended position. Communication system 82 can provide such valve and seal data to communication module 84 and can instruct associated actuators to operate the valves and seal members 44 accordingly.

In the example embodiments of FIGS. 2 and 3, first pressure gauge 88 can measure a pressure within annular space 77 that is on a first side of all of the seal members 44. As used herein, a first side of all of the seal members 44 means a location that is uphole of all of the seal members 44 or downhole of all of the seal members, as the case may be. Second pressure gauge 92 can measure a pressure within annular space 77 that is on an opposite second side of all of the seal members 44. As used herein, a second side of all of the seal members 44 means a location that is uphole of all of the seal members 44 or downhole of all of the seal members, as the case may be, and located at an opposite side of all of the seal members 44 from the first side of all of the seal members 44.

Intermediate pressure gauge 90 can measure a pressure within annular space 77 that is between adjacent seal members 44. Central bore pressure gauge 94 can measure a pressure within central passage 34 of mandrel 32. Each of the pressure gauges 86 can provide pressure data to communication module 84 by way of a system of communication cables 96 that extend through a sidewall of mandrel 32.

The pressure data can be delivered to the surface by communication module 84 by way of a telemetry system such as by way of a copper or fiber cable, acoustic signal, radio-frequency identification tag, or mud pulse. An operator at the surface can utilize the pressure data to determine pressure differentials across each seal member 44 and valve and can signal appropriate valves to operate to manipulate the pressure differentials to ensure such pressure differentials are maintained within safe and acceptable ranges. Alternately the pressure data can be used by communication module 84 to automatically or autonomously manipulate various valves of the sealing assembly 28 without the need for transmitting such data to the surface.

Sealing assembly 28 further includes second end port 98. Second end port 98 is located on a second side of all of the seal members 44. Second end port 98 is an opening that extends through the sidewall of mandrel 32, providing a fluid flow path between central passage 34 of mandrel 32 and annular space 77 on a second side of all of the seal members 44. In the example embodiment of FIGS. 2 and 3 second end port 98 is part of sealing tool 30. In alternate embodiments second end port 98 could be part of second string 20.

Second end valve 100 is associated with second end port 98. Second end valve 100 can move between an open position and a closed position. In the open position second end valve 100 provides a path for flow of the fluid between central passage 34 and the exterior of mandrel 32 on a second side of all of the seal members 44. In the closed position second end valve 100 prevents flow of the fluid through second end port 98 between central passage 34 and the exterior of mandrel 32. Second end electromechanical actuator 102 can be used to move second end valve 100 between the open position and the closed position. Communication system 82 can be used to instruct second end electromechanical actuator 102 to move second end valve 100 between the open position and the closed position.

Sealing assembly 28 further includes first end port 104. First end port 104 is located on a first side of all of the seal members 44. First end port 104 is an opening that extends through the sidewall of first string 18, providing a fluid flow path between first inner bore 40 of first string 18 and annular space 77 on the first side of all of the seal members 44. In the example embodiment of FIGS. 2 and 3 first end port 104 is part of first string 18. In alternate embodiments first end port 104 could be part of sealing tool 30.

First end valve 106 is associated with first end port 104. First end valve 106 can move between an open position and a closed position. In the open position first end valve 106 provides a path for flow of the fluid between central passage 34 and the exterior of sealing assembly 28 on a first side of all of the seal members 44. In the closed position second end valve 100 prevents flow of the fluid through first end port 104 between central passage 34 and the exterior of sealing assembly 28. An actuator can be used to move first end valve 106 between the open position and the closed position. Communication system 82 can be used to instruct the actuator to move first end valve 106 between the open position and the closed position.

In example embodiments, each of the ports and other flow paths of sealing assembly 28 can include features to mitigate the buildup of hydrates. As an example, heating elements can be embedded within mandrel 32. Alternately channels can be formed within mandrel 32 that will allow for the injection of hydration prevention treatments.

In an example of operation and looking at FIG. 1, sealing tool 30 can be secured to first string 18 and second string 20 to form sealing assembly 28. String 16, which now includes sealing tool 30, can be run into wellbore 12 using conventional methods. Sealing assembly 28 can be used within wellbore 12 in situations where a wellbore seal is required that will be subjected to a pressure differential across the sealing assembly 28 during a downhole operation, such as a well treatment, evaluation, or testing operation.

As an example, sealing assembly 28 may be subject to a situation where a hydrostatic pressure of 10,000 psi must be reduced to 2,000 psi to perform the desired downhole operation. In such a situation, sealing assembly would be subjected to a pressure differential across the seal members of 8,000 psi. Embodiments of this disclosure can provide a reliable seal across wellbore 12 even if wellbore 12 has adverse well conditions, such as wellbore 12 having potentially oval shape or having a downhole temperature of 350° F. or greater.

Looking at FIG. 2, while string 16 is being delivered into wellbore 12, seal members 44 are in a retracted position. While string 16 is being delivered into wellbore 12, pressure communication valve 78 and second end valve 100 can be in the closed position and first end valve 106 can be in the open position. Alternately, pressure communication valve 78, second end valve 100, and first end valve 106 can each be in the open position.

After sealing assembly 28 has been lowered to the desired depth within wellbore 12, seal members 44 can be moved to the extended position of FIG. 3. In order to move seal members 44 to the extended position communication system 82 can instruct piston members 56 to move axially in a first direction towards seal supports 50. Piston members would act on seal supports 50 so that seal supports 50 compress seal members 44. The compression of seal members 44 causes radial extrusion of seal members 44, moving seal members the retracted position (FIG. 2) to the extended position (FIG. 3). In the extended position seal members 44 engage interior surface 46 of wellbore 12 and form a pressure and fluid seal with interior surface 46 of wellbore 12.

During activation of seal members 44, both second end valve 100 and first end valve 106 can be in an open position. Looking at FIG. 3, with seal members 44 in the extended position annular space 77 is divided into three separate pressure zones. First annular pressure zone 108 is a portion of annular space 77 located on a first side of all of the seal members 44. Second annular pressure zone 110 is a portion of annular space 77 located between adjacent seal members 44. Third annular pressure zone 112 is a portion of annular space 77 located on a second side of all of the seal members 44. In alternate body with more than two seal members 44 there would be additional separate annular pressure zones.

When both second end valve 100 is in the open position and first end valve 106 is in the open position, the pressure of first annular pressure zone 108 is equalized with the pressure of third annular pressure zone 112. When each of second end valve 100 is in the open position, first end valve 106 in the open position and pressure communication valve 78 is in the open position, then the pressure of first annular pressure zone 108 is equalized with the pressure of second annular pressure zone 110, and is equalized with the pressure of third annular pressure zone 112.

In order to provide a reduced hydrostatic pressure for performing a wellbore operation, after moving each of the seal members 44 from the retracted position to the extended position second end valve 100 can be moved to the closed position. With second end valve 100 in the closed position there is no longer a fluid flow path between first annular pressure zone 108 and third annular pressure zone 112. Pressure communication valve 78 can be in an open position so that there is a fluid flow path between first annular pressure zone 108 and second annular pressure zone 110.

Pressure within first annular pressure zone 108 can then be reduced. Reducing the pressure within first annular pressure zone 108 can be accomplished, for example, by pumping a lighter fluid or gas into first inner bore 40 of first string 18 to reduce hydrostatic pressure. The reduction in hydrostatic pressure can be accomplished using, for example, nitrogen or reservoir fluids. In such an embodiment, heavier fluid can be circulated back to the surface. As an example, a separate tubular member, such as a coil tubing, can be run down hole inside inner bore 40. Lighter fluid can then be pumped downhole inside the separate tubular member and circulated back to surface outside of the separate tubular member but inside inner bore 40. With pressure communication valve 78 in an open position, as pressure of first annular pressure zone 108 is reduced, pressure within second annular pressure zone 110 is also reduced.

During operation of sealing assembly 28 pressure within first annular pressure zone 108, second annular pressure zone 110, third annular pressure zone 112, and within central passage 34 can be monitored with pressure gauges 86. In alternate embodiments there could be no pressure gauges and hydrostatic pressure and differential pressures could instead be calculated by an operator by taking into account true vertical depth and relative fluid density. In either embodiment, the operator can monitor the hydrostatic pressure and pressure differentials to ensure that such values remain within desired and safe ranges.

Pressure within first annular pressure zone 108 can be lowered such that a pressure differential across second seal member 66 has reached a target value, which is not greater than the maximum safe pressure differential across second seal member 66. As an example, the target pressure differential across second seal member 66 could be 80 percent (%) of a maximum allowable pressure differential across second seal member 66 to provide a safety margin. Note that the value of the maximum allowable pressure differential across second seal member 66 can vary for a particular seal member, because such value is based in part on the conditions within wellbore 12, such as the temperature and the irregularity of interior surface 46 of subterranean well 10.

After the pressure differential across second seal member 66 has been reached, pressure communication valve 78 can be moved to the closed position. With pressure communication valve 78 moved to the closed position, there is no longer fluid communication between first annular pressure zone 108 and second annular pressure zone 110. With pressure communication valve 78 moved to the closed position pressure within second annular pressure zone 110 will remain constant. If no changes are made to the pressure within third annular pressure zone 112, then the pressure differential across second seal member 66 will remain constant, even as pressure within first annular pressure zone 108 is further reduced.

Pressure within first annular pressure zone 108 can be further reduced until the first of either the pressure within first annular pressure zone 108 has reached the desired pressure for performing the planned downhole operation, or the pressure differential across first seal member 64 has reached the target pressure differential which is not greater than the maximum safe pressure differential across first seal member 64. As an example, the target pressure differential across first seal member 64 could be 80% of a maximum allowable differential across first seal member 64 to provide a safety margin. Note that the value of the maximum allowable pressure differential across first seal member 64 can vary for a particular seal member, because such value is based in part on the conditions within wellbore 12, such as the temperature and the irregularity of interior surface 46 of subterranean well 10. In order to determine a maximum allowable pressure differential across a particular seal member under particular conditions, such seal member can be tested under the particular conditions to determine the pressure at which the seal member will fail. A pressure safety margin would then be applied to the pressure at which the seal member failed to arrive at a maximum safe pressure differential or target pressure differential.

If there are more than two seal members 44, the process of further reducing the pressure of first annular pressure zone 108 can continue, with successive pressure communication valves being moved to the closed position as the target pressure differential across successive seal members is reached. When the target pressure differential across the final seal member is reached, the maximum safe pressure differential across the entire sealing assembly 28 has been reached. Therefore, the total pressure differential across the entire sealing assembly 28 can be adjusted by incorporating the number of seal members required so that the sum of target pressure differentials across each seal member 44 is equal to at least the desired pressure differential across the entire sealing assembly 28.

As an example, if there are two seal members 44 and each seal member 44 can safely withstand a pressure differential across seal member 44 of 4,000 psi in the adverse down hole conditions of the example wellbore, the target pressure differential can be 4,000 psi. Sealing assembly 28 would therefore be able to withstand differential pressure across entire sealing assembly 28 of 2×4,000 psi or 8,000 psi. If third seal member is added that can also safely withstand a pressure differential across seal member 44 of 4,000 psi in the adverse downhole conditions of the example wellbore, then sealing assembly 28 would be capable to withstand a pressure differential of 3×4,000 psi or 12,000 psi.

After completing the desired downhole operation at the reduced pressure, sealing assembly 28 can be deactivated and retrieved. In order to deactivate sealing assembly 28 a heavier or higher density fluid can be pumped into first inner bore 40 of first string 18 to increase hydrostatic pressure in first annular pressure zone 108. Increasing hydrostatic pressure in first annular pressure zone 108 would decrease the pressure differential across first seal member 64. The heavier fluid could be, for example, drilling mud with a selected density to restore original hydrostatic pressure.

When the pressure within first annular pressure zone 108 is proximate to the pressure within second annular pressure zone 110, then pressure communication valve 78 can be moved to the open position. As an example, pressure communication valve 78 can be moved to the open position when the difference between the pressure within first annular pressure zone 108 and the pressure within second annular pressure zone 110 is 0-15% of the pressure within second annular pressure zone 110. With pressure communication valve 78 in the open position first annular pressure zone 108 is in fluid communication with second annular pressure zone 110 and pressure within second annular pressure zone 110 will be equalized with pressure within first annular pressure zone 108.

After pressure communication valve 78 has been moved to the open position the pressure of first annular pressure zone 108 can be further increased. When the pressure within first annular pressure zone 108 and second annular pressure zone 110 is proximate to the pressure within third annular pressure zone 112, then second end valve 100 can be moved to the open position. With second end valve 100 in the open position first annular pressure zone 108 and second annular pressure zone 110 are in fluid communication with third annular pressure zone 112 and pressure within third annular pressure zone 112 will be equalized with pressure within first annular pressure zone 108 and second annular pressure zone 110.

With pressure within third annular pressure zone 112 equalized with pressure within first annular pressure zone 108 and second annular pressure zone 110, seal members 44 can be moved to the retracted position. In order to move seal members 44 to the retracted position communication system 82 can instruct piston members 56 to move axially in a second direction away from seal supports 50. In certain embodiments seal members 44 or seal actuator 48 can include springs for returning seal members 44 to the retracted position.

After seal members 44 are moved to the retracted position, sealing assembly 28 can be moved to another location within subterranean well 10 or can be retrieved from subterranean well 10 to be used at another well. In certain embodiments sealing assembly 28 can be reused a number of times. In embodiments of this disclosure sealing assembly 28 could be operated through five to twenty cycles of moving seal members 44 from the retracted position to the extended position and back to the retracted position before sealing assembly is reworked or retired.

Embodiments described in this disclosure therefore provide systems and methods that provide a high pressure packer capable of functioning in open hole hostile environments. The number of seal members of the current disclosure can be adjusted to handle a desired pressure differential across the entire sealing assembly.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A sealing assembly for forming a seal within a subterranean well, the sealing assembly including:

a sealing tool, the sealing tool having:

a mandrel, the mandrel being an elongated tubular member with a central passage;

two or more seal members circumscribing the mandrel, the seal members moveable between a retracted position where the two or more seal members have a minimal outer diameter and an extended position where the two or more seal members have an expanded outer diameter;

a seal actuator operable to move the two or more seal members between the retracted position and the extended position;

a pressure communication port located between adjacent of the two or more seal members, the pressure communication port including an opening through a sidewall of the mandrel extending from the central passage to an exterior of the sealing tool;

a pressure communication valve associated with the pressure communication port, the pressure communication valve operable to move between an open position where the pressure communication valve provides a path for flow of a fluid between the central passage and the exterior of the sealing tool between adjacent of the two or more seal members, and a closed position where the pressure communication valve prevents flow of the fluid through the pressure communication port;

a first end port, the first end port located on first side of all of the two or more seal members; and a first end valve associated with the first end port, the first end valve operable to move between an open position where the first end valve provides a path for flow of the fluid between the central passage and an exterior of the sealing assembly on first side of all of the two or more seal members, and a closed position where the first end valve prevents flow of the fluid through the first end port.

2. The sealing assembly of claim 1, where a number of pressure communication ports is one less than a number of seal members.

3. The sealing assembly of claim 1, where the seal actuator includes a piston assembly operable to move all of the two or more seal members between the retracted position and the extended position.

4. The sealing assembly of claim 1, further including:

a second end port, the second end port located on a second side of all of the two or more seal members; and a second end valve associated with the second end port, the second end valve operable to move between an open position where the second end valve provides a path for flow of the fluid between the central passage and the exterior of the mandrel on the second side of all of the two or more seal members, and a closed position where the second end valve prevents flow of the fluid through the second end port.

5. The sealing assembly of claim 1, further including a communication system, the communication system operable to instruct the pressure communication valve to move between the open position and the closed position.

6. The sealing assembly of claim 1, where the sealing tool includes a first connector oriented to secure the sealing tool to a first string, and a second connector oriented to secure the sealing tool to a second string, the first string and the second string each having an inner bore axially aligned and in fluid communication with the central passage of the mandrel.

7. The sealing assembly of claim 1, further including a pressure gauge operable to measure a pressure of the fluid.

8. A sealing assembly for forming a seal within a subterranean well, the sealing assembly including:

a sealing tool, the sealing tool being located within the subterranean well, defining an annular space between an exterior surface of the sealing tool and an interior surface of the subterranean well, the sealing tool having:

a mandrel, the mandrel being an elongated tubular member with a central passage;

two or more seal members circumscribing the mandrel, the seal members moveable between a retracted position where the two or more seal members are spaced apart from the interior surface of the subterranean well and an extended position where the two or more seal members form a seal with the interior surface of the subterranean well; and a pressure communication port located between adjacent of the two or more seal members, the pressure communication port including an opening through a sidewall of the mandrel and extending from the central passage to the annular space between adjacent of the two or more seal members, the pressure communication port having a pressure communication valve operable to move between an open position and a closed position;

a first string secured to a first connector of the sealing tool, the first string having a first inner bore axially aligned and in fluid communication with the central passage of the mandrel;

a second string secured to a second connector of the sealing tool, the second string having a second inner bore axially aligned and in fluid communication with the central passage of the mandrel; and a first end port, the first end port extending through a sidewall of the first string, the first end port having a first end valve operable to move between an open position and a closed position.

9. The sealing assembly of claim 8, further including a piston assembly operable to move all of the two or more seal members between the retracted position and the extended position.

10. The sealing assembly of claim 8, further including a second end port, the second end port being an opening through a sidewall of the mandrel extending from the central passage to the annular space on a second side of all of the two or more seal members, the second end port having a second end valve operable to move between an open position and a closed position.

11. The sealing assembly of claim 8, further including a communication system, the communication system operable to instruct the pressure communication valve to move between the open position and the closed position.

12. The sealing assembly of claim 8, further including a pressure gauge operable to measure a pressure of the fluid.

13. A method for forming a seal within a subterranean well with a sealing assembly, the method including:

providing a sealing tool, the sealing tool having:

a mandrel, the mandrel being an elongated tubular member with a central passage;

two or more seal members circumscribing the mandrel, the seal members moveable between a retracted position where the two or more seal members have a minimal outer diameter and an extended position where the two or more seal members have an expanded outer diameter;

a seal actuator operable to move the two or more seal members between the retracted position and the extended position;

a pressure communication port located between adjacent of the two or more seal members, the pressure communication port including an opening through a sidewall of the mandrel and extending from the central passage to an exterior of the sealing tool;

a pressure communication valve associated with the pressure communication port, the pressure communication valve operable to move between an open position where the pressure communication valve provides a path for flow of a fluid between the central passage and the exterior of the sealing tool between adjacent of the two or more seal members, and a closed position where the pressure communication valve prevents flow of the fluid through the pressure communication port;

a second end port, the second end port located on a second side of all of the two or more seal members;

a second end valve associated with the second end port, the second end valve operable to move between an open position where the second end valve provides a path for flow of the fluid between the central passage and the exterior of the mandrel on a second side of all of the two or more seal members, and a closed position where the second end valve prevents flow of the fluid through the second end port;

a first end port, the first end port located on first side of all of the two or more seal members;

a first end valve associated with the first end port, the first end valve operable to move between an open position where the first end valve provides a path for flow of the fluid between the central passage and an exterior of the sealing assembly on first side of all of the two or more seal members, and a closed position where the first end valve prevents flow of the fluid through the first end port; and where when both the second end valve is in the open position and the first end valve is in the open position, a second side pressure within the subterranean well radially outward of the sealing tool and on a second side of all of the two or more seal members is equal to a first side pressure within the subterranean well radially outward of the sealing tool and on first side of all of the two or more seal members;

engaging an interior surface of the subterranean well with each of the two or more seal members; and moving the second end valve from the open position to the closed position after moving each of the two or more seal members from the retracted position to the extended position.

14. The method of claim 13, where the seal actuator includes a piston assembly and the method further includes moving all of the two or more seal members between the retracted position and the extended position with the piston assembly.

15. The method of claim 13, further including instructing the pressure communication valve to move between the open position and the closed position with a communication system.

16. The method of claim 13, further including securing the sealing tool to a first string with a first connector, and securing the sealing tool to a second string with a second connector, the first string and the second string each having an inner bore axially aligned and in fluid communication with the central passage of the mandrel.

17. The method of claim 13, further measuring a pressure of the fluid with a pressure gauge.

* * * * *